US009163566B2

(12) United States Patent
Le Forestier et al.

(10) Patent No.: US 9,163,566 B2
(45) Date of Patent: Oct. 20, 2015

(54) VALVE ACTUATION MECHANISM AND AUTOMOTIVE VEHICLE COMPRISING SUCH A VALVE ACTUATION MECHANISM

(75) Inventors: Romain Le Forestier, Reyrieux (FR); Romain Riviere, Pollionnay (FR)

(73) Assignee: Volvo Trucks AB, Göteborg (DE)

( * ) Notice: Subject to any disclaimer, the term of this patent is extended or adjusted under 35 U.S.C. 154(b) by 137 days.

(21) Appl. No.: 14/127,259

(22) PCT Filed: Jul. 6, 2011

(86) PCT No.: PCT/IB2011/002189

§ 371 (c)(1),
(2), (4) Date: Dec. 18, 2013

(87) PCT Pub. No.: WO2013/005070

PCT Pub. Date: Jan. 10, 2013

(65) Prior Publication Data

US 2014/0130774 A1 May 15, 2014

(51) Int. Cl.

| | |
|---|---|
| ***F01L 1/18*** | (2006.01) |
| ***F02D 9/06*** | (2006.01) |
| ***F01L 13/00*** | (2006.01) |
| ***F01L 13/06*** | (2006.01) |
| ***F01L 13/08*** | (2006.01) |
| ***F01L 1/24*** | (2006.01) |

(52) U.S. Cl.

CPC . *F02D 9/06* (2013.01); *F01L 1/181* (2013.01); *F01L 1/2416* (2013.01); *F01L 13/0021* (2013.01); *F01L 13/06* (2013.01); *F01L 13/08* (2013.01)

(58) Field of Classification Search

USPC ..... 123/90.39, 90.44, 90.45, 90.46

See application file for complete search history.

(56) References Cited

U.S. PATENT DOCUMENTS

| | | | |
|---|---|---|---|
| 5,890,469 | A | 4/1999 | Hakansson et al. |
| 6,253,730 | B1 | 7/2001 | Gustafson |

(Continued)

FOREIGN PATENT DOCUMENTS

| | | | |
|---|---|---|---|
| WO | 9009514 | A1 | 2/1990 |
| WO | 9108391 | A1 | 6/1991 |

(Continued)

OTHER PUBLICATIONS

International Search Report (Mar. 21, 2012) for responding International application No. PCT/IB2011/002189.

*Primary Examiner* — Hung Q Nguyen
(74) *Attorney, Agent, or Firm* — WRB-IP LLP

(57) ABSTRACT

A valve actuation mechanism includes rockers moved by a camshaft, each rocker being adapted to exert a valve opening force on at least a portion of a valve opening actuator of each cylinder, via an activation piston, housed in a bore of the rocker and movable with respect to the rocker under action of a fluid pressure raise in a chamber fluidly linked to the bore, from a first position to a second position, in which a cam follower of the rocker reads at least one auxiliary cam sector of a cam of the camshaft so as to perform an engine operating function. Each rocker includes a reset valve adapted to reduce fluid pressure in the chamber. The valve actuation mechanism includes, for each rocker, a reset cam profile adapted to open the reset valve when the activation piston has to be moved from its second position to its first position, and each reset valve includes a cam follower adapted to drive the reset valve as a function of the movement of the reset profile.

18 Claims, 5 Drawing Sheets

(56) References Cited

U.S. PATENT DOCUMENTS

| | | | | |
|---|---|---|---|---|
| 6,386,160 | B1 | 5/2002 | McNeely et al. | |
| 7,392,777 | B2 * | 7/2008 | Faria et al. | 123/90.39 |
| 2003/0024501 | A1 | 2/2003 | McCarthy et al. | |
| 2010/0307451 | A1 | 12/2010 | Lee et al. | |

FOREIGN PATENT DOCUMENTS

| | | | |
|---|---|---|---|
| WO | 0146578 | A1 | 6/2001 |
| WO | 2011075008 | A1 | 6/2011 |

* cited by examiner

VALVE ACTUATION MECHANISM AND AUTOMOTIVE VEHICLE COMPRISING SUCH A VALVE ACTUATION MECHANISM

BACKGROUND AND SUMMARY

The invention concerns a valve actuation mechanism for an internal combustion engine on an automotive vehicle. The invention also concerns an automotive vehicle, such as a truck, equipped with such a valve actuation mechanism.

Automotive vehicles, such as trucks, often rely on an engine brake function to slow down in order, for example, to reduce wear of the friction brake pads and to prevent overheating of the friction brakes, particularly on downward slopes. It is known to perform engine brake by acting on the amount of gas present in the cylinders of the engine in two distinct phases. In a first phase, when the pistons are near a bottom dead center, one injects exhaust gases into the chambers of the cylinders so as to slow down the pistons when they move towards their high level. This is done by slightly opening at least a valve connected to an exhaust manifold, while exhaust gases are prevented to be expelled from the exhaust pipe and thereby at a certain pressure above atmospheric pressure. In the second phase, the gases which are compressed by the piston are expelled from the chamber of the cylinder when the piston is at or near its top dead center position in order to prevent an acceleration of the piston under effect of volcanic expansion of compressed gas. This is done by slightly opening a valve so as to expel gases from the cylinder. In most cases, the valve (or valves) which is (are) opened for the engine brake function is (are) a main exhaust valve. An engine brake system is described in document WO 9009514.

To perform these engine brake valves movements, also called engine brake valves lifts, the engine comprises, for each cylinder, a rocker acting, on the valves to open and close them. The rocker is acted upon by a rotating cam which has at least one lift sector to cause the lifting (opening) of the valve. If the valve is also an exhaust or an intake valve, the corresponding cam will comprise a main valve lift sector and one or several auxiliary valve lift sectors (also called main valve lift bump and auxiliary valve lift bump) When engine brake is needed, a cam follower surface of the rocker is moved in close contact with a cam of a camshaft moving the rocker so that the brake movements of the valve are obtained, when the cam follower interacts with the auxiliary valve lift sectors. In normal operating conditions of the engine, the valves should not perform these movements and the roller of the rocker is kept slightly remote from the cam so that the cam follower does not interact with the auxiliary valve lift sectors. The distance or clearance between the roller and the cam ensures that only the larger main lift sector on the cam, dedicated to the main exhaust event, causes an opening of the exhaust valve, but not one or several smaller auxiliary lift sectors dedicated to the engine brake function. This clearance is suppressed when engine brake is needed, by moving an activation piston of the rocker to make a close contact between the roller and the cam, so that engine brake dedicated lift sectors on the cam also cause an opening of the valve. An engine brake system having such valve actuation mechanism is described in WO-91/08381

In the case of a system where two valves are to be actuated, the piston can be in contact with the valves through a valve bridge.

When the engine brake valve opening(s) have been performed, a reset function is preferably to be performed. In other words, the activation piston needs to be moved towards its initial position in order to ensure that the valves are closed early enough before fuel admission, in order to prevent negative airflow by valve overlapping.

Engine brake systems generally comprise a control valve to direct pressurized control fluid pressure in a chamber adjacent to the piston to move the activation piston from its initial position to its engine brake actuation position. The control valve controls whether or not the engine brake function is activated. This control valve lets pressurized control fluid flow, at a pressure of for example 2 to 5 bars, towards each rocker as long as the engine brake function is needed. which typically lasts several seconds or tens of seconds during which the engine and the cam shaft may perform several hundreds or thousands of complete revolutions. In some systems, a check valve is provided to prevent any fluid flow out of the chamber. In some known systems, such as the one described in WO-91/08381, the check valve can nevertheless be forced to an open position, allowing the control fluid to escape the chamber when the engine brake is not needed. This is achieved when no control pressure is sent to the control valve. In known systems, there is only one control valve for several cylinders, so that it is not possible to use the control valve to empty the chamber to allow retraction of the piston, if such retraction is needed for a period of time inferior to one revolution of the camshaft.

It is known from U.S. Pat. No. 5,890,469 to use a rotating by-pass valve, housed inside the rocker and which opens or closes a fluid circuit in which a pressure raise provokes the outward movement of the piston. This by-pass valve is opened when the piston must be pushed back. The by-pass valve is rotated by a gear fixed to the rotation axis of the rocker. The solution of U.S. Pat. No. 5,890,469 is not entirely satisfying because, when a single valve engine brake technology is used, the reset valve opens the fluid circuit but at a time when no force is exerted on the piston to push it back in its normal position so that it tends to stay in a second position. At the time the valve springs exert a force on the piston, the fluid circuit is not opened, tending to prevent the piston from moving back to its first position.

It is desirable to provide a valve actuation mechanism in which, when a specific operation of the engine must he activated, the piston can be reset to its first position by using the by-pass valve especially with a single valve brake technology.

To this end, an aspect of the invention concerns a valve actuation mechanism for an internal combustion engine on an automotive vehicle, comprising rockers moved by a camshaft, each rocker being adapted to exert a valve opening force on at least a portion of a valve opening actuator of each cylinder, via an activation piston of the rocker, movable with respect to the rocker under action of a fluid pressure raise in a chamber, from a first position, to a second position, in which a cam follower of the rocker reads at least one auxiliary valve lift sector of a cam of the camshaft so as to perform an engine operating function, each rocker comprising a reset valve, adapted to release fluid pressure in the chamber. The valve actuation mechanism is characterized in that it comprises, for each rocker, a reset cam profile adapted to open the reset valve when the brake activation piston has to be moved from its second position to its first position, and in that each reset valve comprises a cam follower, adapted to drive the reset valve as a function of the movement of the reset profile.

Thanks to an aspect of the invention, the movement of the reset valve is not only dependant on the movements of the rocker and can be controlled by the movements of the reset cam or of the cam follower. This permits to open the reset valve exactly when needed and independently for each rocker. The fluid circuit is opened and the pressure reduced at the moment when the force of the springs which maintain the valves in their closed position is exerted on the activation piston. This permits to reduce the valve overlapping between the intake and the exhaust valves.

According to further aspects of the invention which are advantageous but not compulsory, such a valve actuation mechanism may incorporate one or several of the following features:

- The reset profile is made on a reset cam of a camshaft of the valve actuation mechanism, and whereas the cam follower of the reset valve cooperates with the reset cam.
- The reset cam is integral with or mounted on the camshaft which moves the rocker on which the reset cam is mounted.
- The reset profile is made on the cam follower of the reset valve, and whereas the reset profile cooperates with the cam which is read by the cam follower of the rocker.
- The cam follower of the reset valve comprises a lever arm.
- The reset valve is rotatable around a longitudinal axis, and whereas the lever arm is fast in rotation with the reset valve.
- The lever are is mounted on a shaft of the reset valve, said shaft protruding outside the rocker along a rotation axis of the reset valve.
- Each rocker comprises a check valve movable between a first position, in which the check valve allows passage of fluid between the chamber and a fluid circuit feeding the chamber, and a second position, in which the check valve blocks passage of fluid between the chamber and the fluid circuit and whereas each reset valve is adapted to bypass the check valve and links the chamber and the fluid circuit feeding the chamber.
- The reset valve comprises two parallel through holes and two parallel grooves linking the through holes with each other, and whereas the through holes communicate with the duct which bypasses the check valve when the reset valve is in its opened position.
- The reset valve comprises a peripheral surface adapted to obturate the duct which bypasses the check valve when the reset valve is in its closed position.
- The reset valve has a cylindrical form with a circular section.
- The valve mechanism is an exhaust valve actuation mechanism.
- The activation piston activates an exhaust gas recirculation function when it is in its second position.
- The activation piston activates an engine brake function when it is in its second position.
- The engine brake function is realized by opening two exhaust valves and whereas the valve opening force is exerted by the activation piston on the whole valve opening actuator.
- The engine brake function is realized by opening one of two exhaust valves, whereas the portion of the valve opening actuator on which the valve opening force is exerted is a slider block, on which said valve is mounted and which is movable, with respect to the valve opening actuator, along the opening axis of said valve, and whereas each rocker comprises a finger adapted to exert, under rotation of the rocker, a valve opening force on the remaining portion of the valve opening actuator, on which the second valve is mounted.
- The valve actuation mechanism is an intake valve actuation mechanism.

The invention also concerns an automotive vehicle, such as a truck, comprising a valve actuation mechanism as mentioned here above.

BRIEF DESCRIPTION OF THE DRAWINGS

The invention will now be explained in correspondence with the annexed figures, as illustrative example. In the annexed figures.

DETAILED DESCRIPTION

Figure 1:
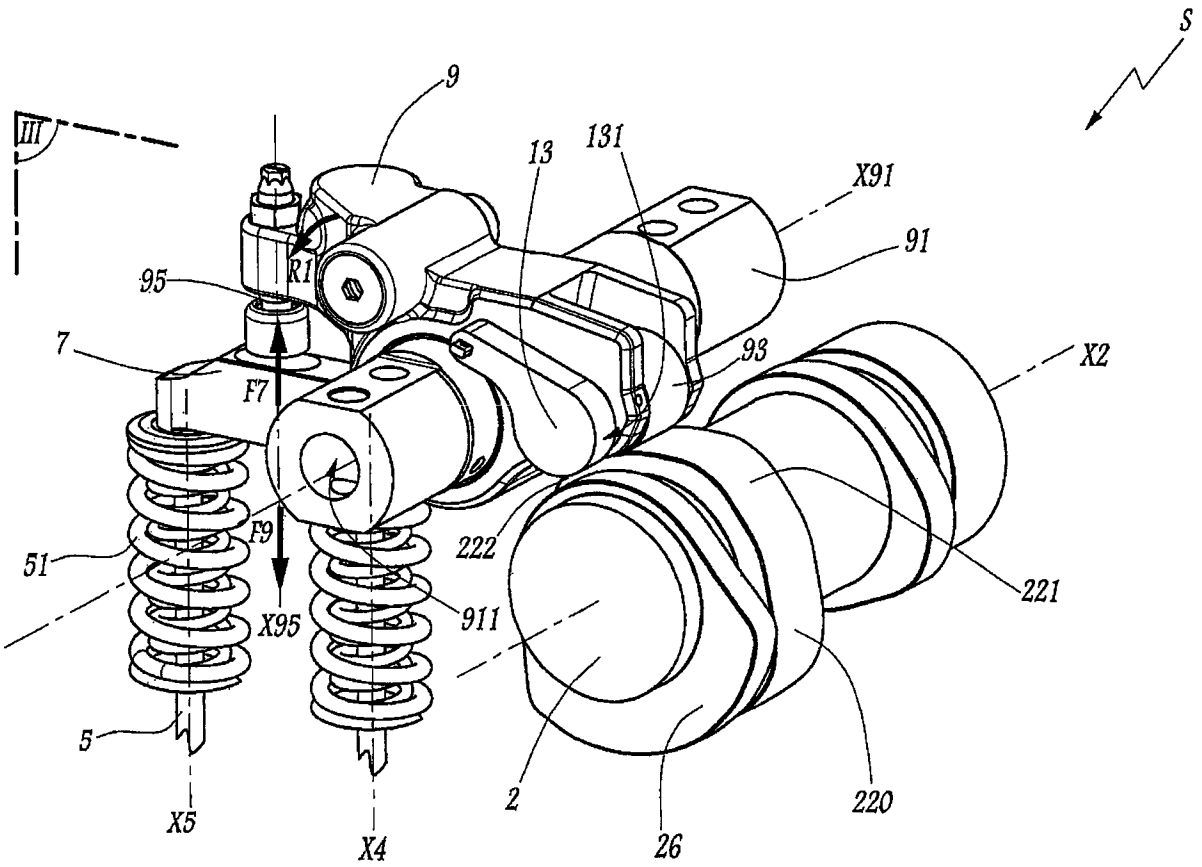
FIG. 1 is a perspective view of a valve actuation mechanism according to a first embodiment of the invention.

The valve actuation mechanism S represented on FIG. 1 comprises a camshaft 2 rotatable around a longitudinal axis X2. Camshaft 2 comprises several cams 22, each being dedicated to moving the valves of one cylinder of an internal combustion engine E of a non-represented automotive vehicle on which valve actuation mechanism S is integrated. Each cam has a cam profile which may comprise one or several "bumps", i.e. valve lift sectors where the cam profile exhibits a bigger eccentricity with respect to axis X2 than the base radius of the cam.

In this embodiment, each cylinder of engine E is equipped with two exhaust valves 4 and 5. Valves 4 and 5 are kept in a closed position by respective springs 41 and 51. Each valve 4 and 5 is movable in translation along an opening axis X4 or X5 so as to be opened, or lifted. More precisely, translation of valves 4 and 5 opens a passageway between the combustion chamber of the cylinder and an exhaust manifold. Valves 4 and 5 are connected to a valve bridge 7, which forms a valve opening actuator, and which extends substantially perpendicularly to axes X4 and X5. in case only one valve is to be actuated, then the opening actuator can be integral with the valve, for example embodied as a top portion of the valve stem.

Figure 2:
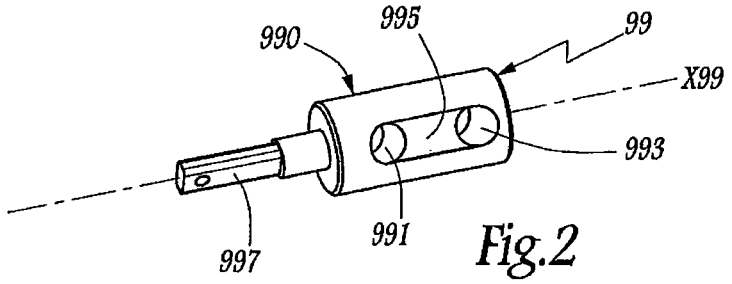
FIG. 2 is a perspective view of a reset valve belonging to the valve actuation mechanism of FIG. 1.
Figure 3:
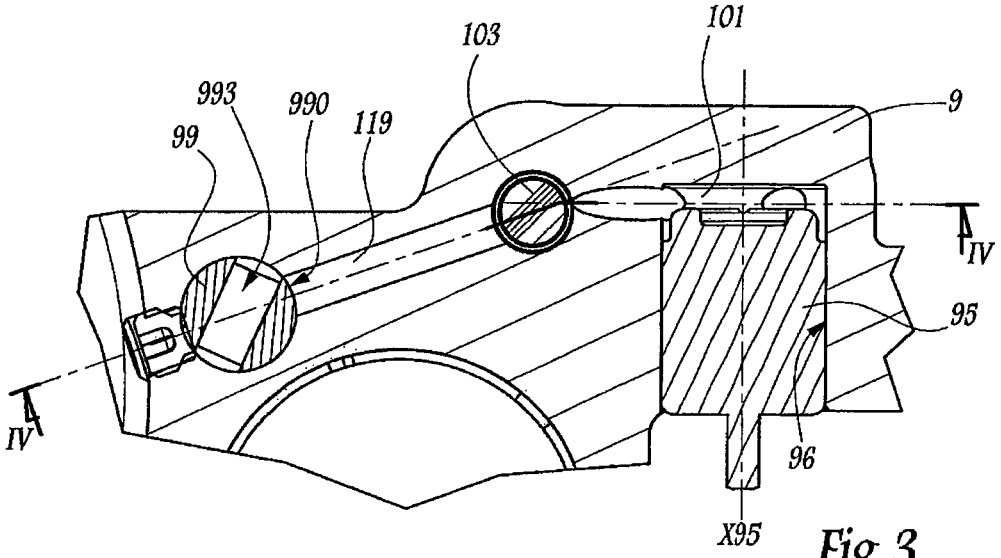
FIG. 3 is a sectional view along plane III on FIG. 1, of a rocker belonging to the valve actuation mechanism of FIG. 1, in a first configuration.

Valves 4 and 5 are partly represented on FIGS. 1 and 2, only their respective stems are visible.

For each cylinder, the transmission of movement between camshaft 2 and valve bridge 7 is performed by a rocker 9 rotatable with respect to a rocker shaft 91 defining a rocker rotation axis X91. Only one rocker 9 is represented on the figures. Each rocker 9 comprises a roller 93 which acts as a cam follower and cooperates with a cam 22. Roller 93 is located on one side of rocker 9 which respect to shaft 91. Each rocker 9 comprises, opposite to roller 93 with respect to shaft 91, an activation piston 95 adapted to exert a valve opening force F9 on the whole of valve bridge 7. Particularly, rotation of camshaft 2 transmits, when the roller runs a valve lift sector of the cam, a rotation movement R1 to rocker 9 via roller 93, this rotation movement inducing a translation movement of valve bridge 7 along an axis X7 which is parallel to axes X4 and X5.

Cooperation between a main valve lift sector 220 of cam 22 and roller 93, on the one hand, and between piston 95 and bridge 7, on the other hand, generates exhaust openings of valves 4 and 5 during the corresponding operating phase of internal combustion engine E.

In the shown embodiment, rocker shaft 91 is hollow and defines a duct 911 which houses a control fluid circuit connected to a non-shown fluid tank of valve actuation mechanism S. Rocker 9 comprises a non represented internal fluid circuit which fluidly connects duct 911 to a piston chamber 101 of rocker 9, delimited by piston 95, via a check valve 97. Piston 95 is housed in to bore 94 of rocker 9 and adapted to move with respect to chamber 101 along a translation axis X95 corresponding to a longitudinal axis of piston 95.

Cam 22 comprises at least one, but here two auxiliary valve lift sectors 221 and 222 which are adapted to cooperate with roller 93. These sectors induce, when read by roller 93 of rocker 9, two additional pivoting movements of rocker 9 on each turn of camshaft 2. The auxiliary lift sectors 221 and 222 are usually designed to cause only a limited lift of the valve, as they are not intended to allow a great flow of gases through the valve. These two pivoting movements are transformed by piston 95 into two opening movements of valves 4 and 5 so as to perform an engine brake function at two precise moments during operation of engine E, as described briefly above. The purpose and effects of these valve openings are well-known and will not be further described hereafter. According to an alternate embodiment, cam 22 comprises only one auxiliary valve lift sector for performing only one opening of valves 4 and 5 on each turn of camshaft 2, in addition to the main exhaust valve opening.

When engine F switches to engine brake mode, check valve 97 is opened so that fluid can flow from duct 911 to the inside of rocker 9 and subsequently to piston chamber 101 so as to induce a pressure raise in piston chamber 101. The pressure raise in chamber 101 induces translation movement of piston 95 outwardly with respect to rocker 9, from a first position, in which piston 95 is entirely or partially pushed back into chamber 101, to a second position, in which piston 95 is partially moved out of piston chamber 101 until it comes in abutment against valve bridge 7. Preferably, the control fluid is a substantially incompressible fluid such as oil.

Figure 4:
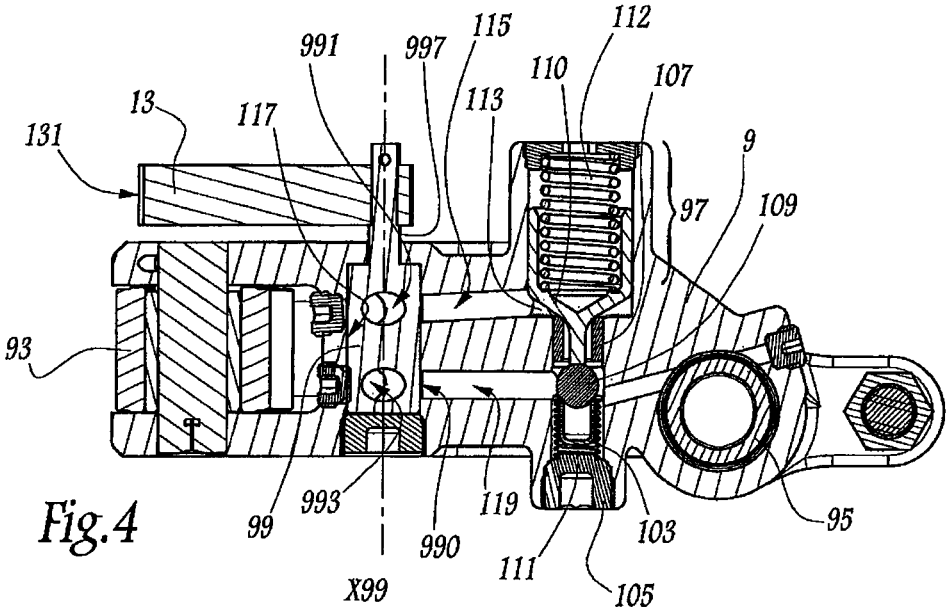
FIG. 4 is a sectional view, along line IV on FIG. 3 of the rocker of FIG. 3.

When piston 95 is in its first position, retracted, as shown on FIG. 2, roller 93 is offset with respect to the auxiliary valve lift sectors 221 and 222 of cam 22 by an engine brake actuation clearance, so that when camshaft 2 rotates around axis X2, cam 22 does not come in contact with roller 93, or piston 95 does not come in contact with valve bridge 7. By moving piston 95 to its second position, extended, as shown on FIG. 4, rocker 9 pivots around the longitudinal axis X91 of shaft 91, in the direction of arrow A1. Thus, the actuation clearance is suppressed and roller 93 comes into contact with the auxiliary valve lift sectors of cam 22, allowing engine brake operations to be implemented.

According to a variant of the invention, piston 95 may be adapted to activate or deactivate an internal exhaust gases recirculation function. This function allows an exhaust valve opening during the intake stroke. By returning a controlled amount of exhaust gas to the combustion process, peak combustion temperatures are lowered. This will reduce the formation of Nitrogen oxides (NOx).

The fluid circuit housed inside rocker 9 comprises a main duct 103 which fluidly links check-valve 97 with piston chamber 101. Main duct 103 opens on the outside of rocker 9 and fluid is prevented from going out of rocker 9 by a shutter element 105 screwed into a threaded portion of main duct 103. A seat element 107 is press-fitted into main duct 103. A ball 109 of check-valve 97 is adapted to cooperate with seat element 107 so as to block passage of fluid from piston chamber 101 back to duct 911. Ball 109 is biased towards seat element 107 by a spring 111 and therefore tends to close the check-valve 97. When no control pressure comes from duct 91, ball 109 is kept in open position by a plunger 110 spring-biased by a spring 112 arranged in chamber 113, the action of the spring 112 being superior to the action of spring 111.

On the other side of check-valve 97 with respect to main duct 103, rocker 9 comprises a fluid inlet chamber 113. Fluid coming from duct 911 first flows into fluid inlet chamber 113. An upstream by-pass duct 115 originates from fluid inlet chamber 113 and comes to a by-pass chamber 117. A downstream by-pass duct 119 fluidly connects bypass chamber 117 to main duct 103. In other words, upstream by-pass duct 115, by-pass chamber 117 and downstream by-pass duct 119 define together a by-pass passage of check-valve 97.

By-pass chamber 117 has a cylindrical form with circular section. Each of ducts 115 and 119 opens into by-pass chamber 117 in the vicinity of one of its planar inner walls.

Rocker 9 further comprises a reset valve 99. The reset valve has the function of allowing control fluid to escape from chamber 101 to allow retraction of the activation piston to its first position.

In the shown embodiment, the reset valve is a distinct valve. It is housed inside bypass chamber 117 and adapted to rotate, around a longitudinal axis X99 of reset valve 99, which corresponds to a longitudinal axis of by-pass chamber 117. Reset valve 99 has a cylindrical form with circular section corresponding to the form of by-pass chamber 117.

Reset valve 99 comprises a first through hole 991, which is perpendicular to axis X99 and opens on opposite zones of the peripheral surface of reset valve 99. In mounted configuration of reset valve 99 in by-pass chamber 117, through hole 991 and upstream by-pass duct 115 are in a same plane perpendicular to axis X99. Reset valve 99 further comprises a second through hole 993 similar to through hole 991 located at the other end of reset valve 993. Through hole 993 and downstream by-pass duct 119 are in a same plane perpendicular to axis X99 in mounted configuration of reset valve 99.

Reset valve 99 further comprises two parallel grooves 995, which are realized parallel to axis X99 on the peripheral surface of reset valve 99. Grooves 995 communicate with through holes 991 and 993. Longitudinal axes of grooves 995 and holes 991 and 993 define a plane containing a diameter of reset valve 99 and axis X99.

On its end located in the vicinity of through hole 991, reset valve 99 comprises a shaft 997 which protrudes outside rocker 9 along axis X99. A lever arm 13 is fixed to shaft 997. Lever arm 13 extends perpendicularly to the axis of the reset valve. In this embodiment, it is drop-shaped and has a thin end on the side of shaft 997, and a circular shaped end comprising a circular rolling surface 131, the axis of which is remote and parallel to axis X99. According to a non-shown alternate embodiment, an intermediate transmission mechanism may transmit the rotation of lever arm 13 to reset valve 99. Camshaft 2 comprises, offset with respect to cam 22 along axis X2, a reset cam 26 having a reset profile which is aligned with rolling surface 131 of lever arm 13, which forms a cam follower. Thus, rotation of camshaft 2 induces, via reset cam 26, the transmission of a rotation movement to lever arm 13 around axis X99.

According to a non-shown alternate embodiment, an intermediate transmission mechanism may transmit the rotation movement from reset cam 26 to lever arm 13.

According to an alternate non-shown embodiment, reset cam 26 may be carried by another shaft of valve actuation mechanism S, independent from camshaft 2.

In the shown example, the reset cam is a rotating cam, but it could be a cam having a different movement, for example an alternate back and forth translation movement synchronized with the rotation of cam 22.

In other words, the rocker 9 comprises a cam follower which is associated to the reset valve is such a way that the cam follower, when cooperating with the reset profile of reset cam, controls the opening or the closing of the reset valve. The cam follower can be integral with the reset valve, as in the embodiment shown on the figures, or distinct therefrom. The cam follower is preferably carried by the rocker.

In any case, the reset profile and the reset cam follower are adapted to create a relative movement of the reset valve 99 with respect to the corresponding rocker. This relative movement is nevertheless coordinated with the movement of the rocker with respect to the engine housing so that the reset function is performed at a selected given time within the opening/closing cycle of the valves 4 and 5.

In this embodiment, rotation of lever arm 13 around axis X99 under action of reset cam 26 induces a rotation of reset valve 99 relative to the corresponding rocker between a closed position and an opened position. In its closed position, reset valve 99 is positioned with respect to by-pass chamber 117 so that upstream by-pass duct 115 and downstream by-pass duct 119 are not aligned with through holes 991 and 993. Upstream bypass duct 115 and downstream bypass duct 119 are obturated by peripheral cylindrical surface 990 of reset valve 99. In this case, fluid can not by-pass check valve 97. In opened position of reset valve 99, through holes 991 and 993 are respectively aligned with upstream by-pass duct 115 and downstream by-pass duct 119. Fluid can therefore flow in grooves 995 and check valve 97 is by-passed.

The invention operates in the following way: before activation of the engine brake function, check valve 97 is in opened position, due to action of the spring biased plunger 110. When the engine brake function is activated, the control valve sends pressurized oil in duct 911. This pressure arrives in 113 below the plunger and forces retraction of the plunger which does not anymore force the check valve to its open position, so that it now functions as a normal check-valve. As long a pressure in chamber 101 is lower than control pressure (3 bars), the control pressure fills chamber 101. Indeed, the spring 111 which biases the ball 109 towards the seat element has a low spring rate and allows opening of the check-valve if pressure on the duct side of the ball 109 is only slightly superior to the pressure on the chamber side of the ball 109, for example by a margin of 0.5 bars. Fluid may then flow through check-valve 97 into piston chamber 101 until pressure raise is sufficient to move piston 95 to its second position. To the contrary, when, due to an external effort on piston 95, fluid in chamber 101 tends to flow backwards towards duct 911, then the check valves closes, preventing such a back-flow. Indeed pressure downstream of ball 109 becomes higher than pressure upstream of ball 109, check valve 97 then closes itself, preventing piston 95 from returning to its first position. Translation of piston 95 induces a rotation of rocker 9 around axis X91, which approaches roller 93 from cams 24. The actuation clearance between roller 93 and cams 24 is therefore suppressed, and engine brake openings of valves 4 and 5 can take place.

Figure 5:
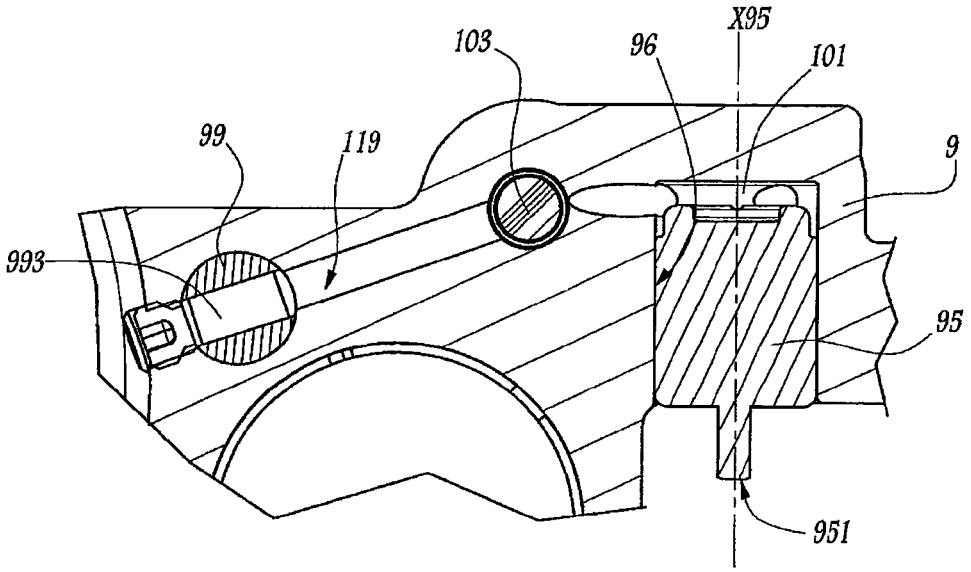
FIG. 5 is a sectional view similar to FIG. 3, for a second configuration of the rocker.
Figure 6:
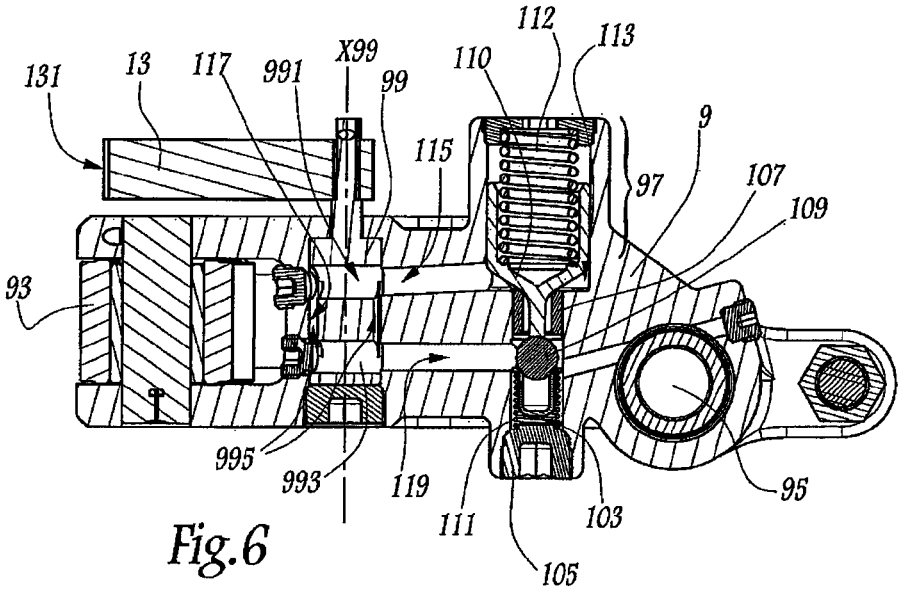
FIG. 6 is a sectional view similar to FIG. 4, for the second configuration of the rocker.

After the engine brake opening movements of valves 4 and 5 have been performed, piston 95 must be returned to its first position. While check valve 97 remains closed, reset cam 26 cooperates with rolling surface 131 so that reset valve 99 rotates around axis X99 towards its opened position represented on FIGS. 5 and 6, in order to let fluid flow in grooves 995 as previously described. This fluid flow induces a pressure equalization between main duct 103 and fluid inner chamber 113. As piston chamber 101 communicates with main duct 103, control fluid is allowed to flow back from chamber 101 and fluid pressure is therefore reduced in piston chamber 101.

In the phase during, which valves 4 and 5 return to their closed position, under effect of the compression force of springs 41 and 51, a compression force F7 is transmitted to piston 95 via valve bridge 7.

Opening of reset valve 99 is performed at a given time during the closing movement of valves 4 and 5, so that piston 9 returns to its first position under action of compression force F7. Piston 95 begins to return to its first position when force F7 becomes superior to the force exerted by fluid pressure in piston chamber 101.

Figure 7:
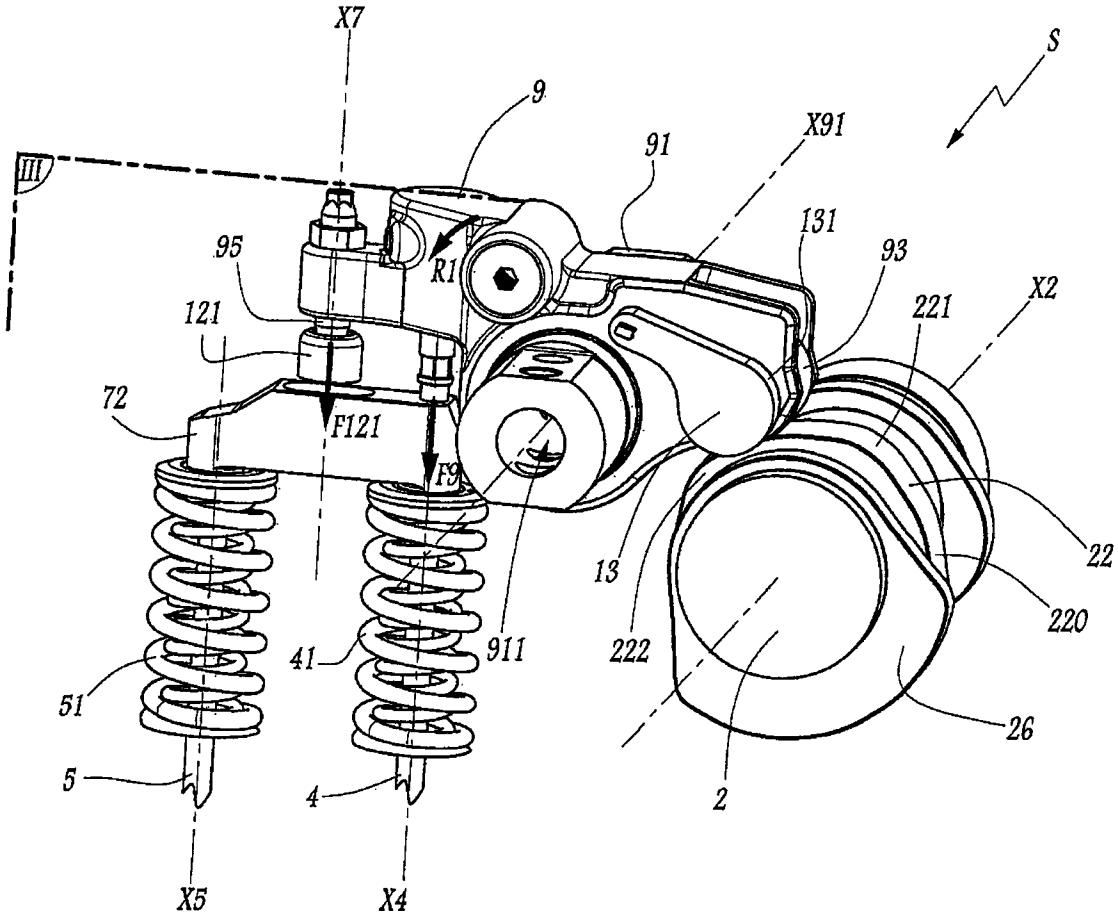
FIG. 7 is a perspective view similar to figure of a valve actuation mechanism according to a second embodiment of the invention.

A second embodiment of the invention is represented on FIG. 7. In this embodiment, elements similar to the first embodiment bear the same references and work in the same way. Particularly, elements shown on FIGS. 2 to 6 are the same and work in the same way in the embodiment of FIG. 7.

In this embodiment, rocker 9, via piston 95, exerts valve opening force F9 only on a portion of valve bridge 7. This portion is a slider block 71. Valve 4 is connected to slider block 71, while valve 5 is connected to the remaining portion 72 of valve bridge 7. Slider block 71 is movable with respect to bridge 7 along opening axis X4 of valve 4. Consequently, valve 4 is also movable with respect to valve bridge 7 along axis X4.

Rocker 9 further comprises a finger 121 substantially parallel to piston 95, and located at a distance, with respect to axis X91, superior to the distance between axis X95 and axis X91. Piston 95 is arranged in rocker 9 so that it cooperates with slider block 71, while finger 121 cooperates with the remaining portion 72 of valve bridge 7, by exerting a valve opening force F121. This embodiment applies to the single valve brake technology, in which only one valve is opened to realize the engine brake function. This technology permits to reduce forces exerted on the valve actuation mechanism, in order to improve the reliability of valve actuation mechanism S and internal combustion engine 2 and/or to allow the exhaust brake valve lifts to be performed at moments where the pressure in the cylinder is higher.

In this embodiment, piston 95 acts on slider block 71 so as to open valve 4. Normal exhaust openings of valves 4 and 5 are implemented as follows. Piston 95 is first moved towards its second position, so that, when the rotation of rocker 9 starts, opening of valve 4 begins. When rotation of rocker 9 goes further, contact is made between finger 121 and bridge portion 72. From this moment on, valve bridge 7 is moved and opening of valve 5 begins.

At a further rotation angle of rocker 9, contact is lost between piston 95 and slider block 91. From this moment on, bridge portion 72 cooperates with slider block 71 thanks to a non-shown stop which cooperates with a non-shown shoulder of slider block 71. Slider block 71, and so on valve 4 become integral in translational movement with bridge portion 72, until the opening of valves 4 and 5 completes.

To allow valves 4 and 5 to return to their closed position, movements of bridge 7 are realized exactly in the opposite manner as for the opening movement until contact is made again between piston 95 and slider block 71. At this moment, as piston chamber 101 is closed, the elastic force of spring 41 is inferior to the force exerted by fluid pressure on piston 95, and valve 4 therefore closes at a smaller speed with respect to valve 5. This provokes valve overlapping, which reduces the efficiency of the engine brake function, because it can provoke admission of warm exhaust gases at a wrong tune.

To reduce this valve crossing effect, reset valve 99 is opened, thanks to reset cam 26, at the time when contact is made between piston 95 and slider block 71, so that the elastic force exerted by spring 41 on valve 4, and transmitted to slider block 71 overcomes the force of fluid pressure in piston chamber 101. This allows to push back piston 95 towards its first position and to insure valves 4 and 5 are substantially synchronized.

Figure 8:
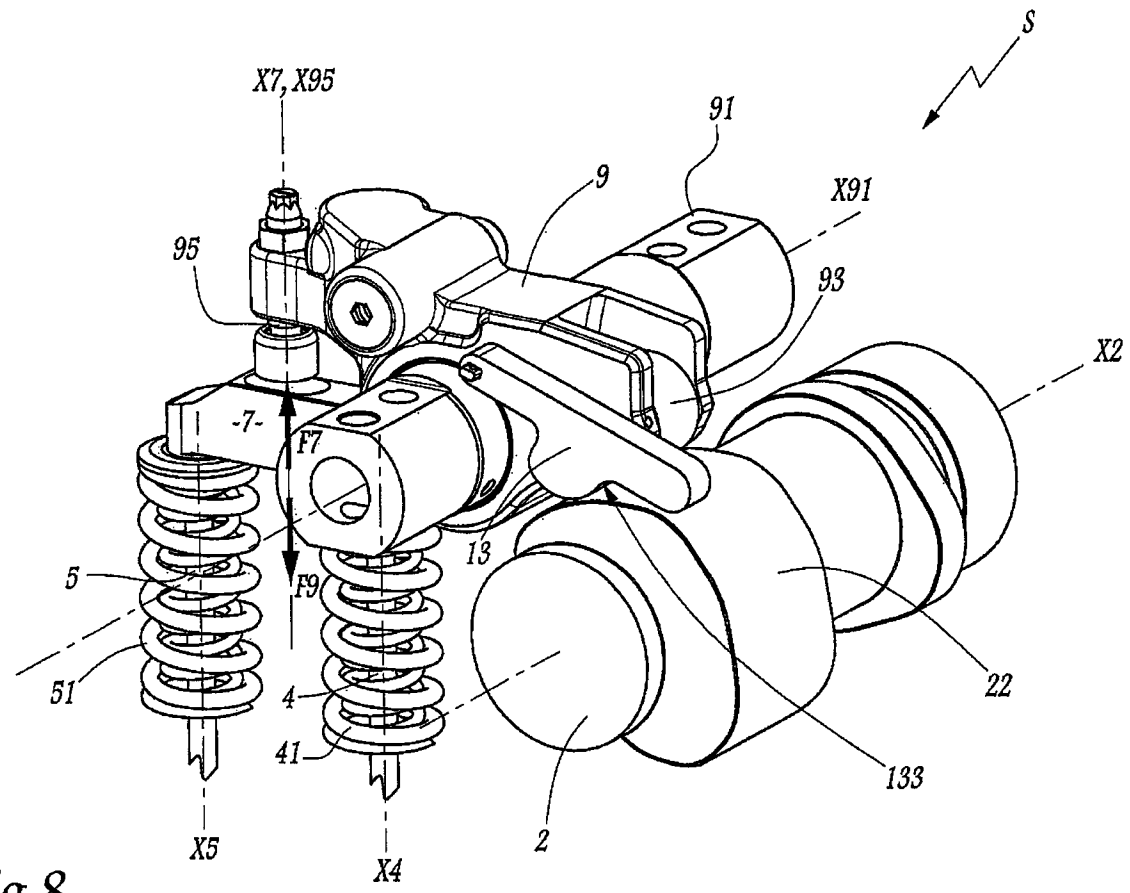
FIG. 8 is a perspective view similar to FIG. 1, of a valve actuation mechanism according to a third embodiment of the invention.

A third embodiment of the invention is represented on FIG. 8. This embodiment is described in combination with the embodiment of FIGS. 1 to 6, in which two valves are moved by the valve actuation mechanism, but may also be implemented with the embodiment of FIG. 7, in which only one valve is moved.

In this embodiment, camshaft 2 does not comprise any specific reset cam 26. Lever arm or cam follower 13 shows a specific profile 133 which cooperates with cam 22 together with roller or cam follower 93. Specific profile 133 forms a reset profile which permits to obtain, under effect of rotation of cam 22, a movement of lever arm 13 which is partially independent from the movement of rocker 9. Reset profile 133 comprises to this end specifically formed cam sectors so as to obtain openings of reset valve 99 at the times when piston 95 most be pushed back to its first position.

According to a non-shown embodiment of the invention, valve actuation mechanism S may apply to an engine having cylinders equipped with a single exhaust valve and a single intake valve. In this case, each rocker 9 is adapted to move only one valve, and the valve opening actuator does not comprise any bridge, the single exhaust or intake valve being moved via an intermediate part adapted to cooperate with piston 95

According to a non-shown alternate embodiment, reset valve 99 may be of a non-rotative type.

In a further non-shown embodiment, the reset valve may be designed to open a communication of the chamber 101 directly to the exterior of the rocker, simply allowing oil a small quantity of oil to escape out of the rocker in order to allow retraction of the activation piston towards its first position.

In the above embodiments, the reset valve is distinct from the check-valve 97. But, in still another embodiment, the reset valve can be embodied as the check-valve itself, which would then only be performing an additional function. For example, a mechanism can be provided so that the reset profile causes the plunger 110 to force the check valve 97 to its open position. Such mechanism would act in parallel to spring 112, but would be able to overcome the pressure in chamber 113 to force the plunger to its extended position where it forces ball 109 off the seat.

The invention claimed is:

1. Valve actuation mechanism for an internal combustion engine on an automotive vehicle, comprising rockers moved by a camshaft, each rocker being adapted to exert a valve opening force on at least a portion of a valve opening actuator of each cylinder, via an activation piston of the rocker and movable with respect to the rocker under action of a fluid pressure raise in a chamber, from a first position, to a second position, in which a cam follower of the rocker reads at least one auxiliary valve lift sector of a cam of the camshaft so as to perform an engine operating function, each rocker comprising a reset valve adapted to release fluid from the chamber, wherein the valve actuation mechanism comprises, for each rocker, a reset cam profile adapted to open the reset valve when the activation piston has to be moved from its second position to its first position, and wherein each rocker comprises a cam follower, adapted to drive the reset valve as a function of the movement of the reset profile.

2. Valve actuation mechanism according to claim 1, wherein the reset profile is made on a reset cam of a camshaft of the valve actuation mechanism, and wherein the cam follower of the reset valve cooperates with the reset cam.

3. The valve actuation mechanism according to claim 2, wherein in the reset cam is integral with or mounted on the camshaft which moves the rocker on which the reset valve is mounted.

4. The valve actuation mechanism according to claim 1 , wherein the reset profile is made on the cam follower of the reset valve and wherein the reset profile cooperates with the cam which is read by the cam follower of the rocker.

5. The valve actuation mechanism according to claim 1, wherein the cam follower of the reset valve comprises a lever arm.

6. The valve actuation mechanism according to claim 5, wherein the reset valve is rotatable around a longitudinal axis, and wherein the lever arm is fast in rotation with the reset valve.

7. The valve actuation mechanism according to claim 6, wherein the lever arm is mounted on a shaft of the reset valve the shaft protruding outside the rocker along a rotation axis of the reset valve.

8. The valve actuation mechanism according to claim 1, wherein each rocker comprises a check valve movable between a first position, in which the check valve allows passage of fluid between the chamber and a fluid circuit feeding the chamber, and a second position, in which the check valve blocks passage of fluid between the chamber and the fluid circuit and wherein each reset valves adapted to bypass the check valve and link the chamber and the fluid circuit feeding the chamber.

9. The valve actuation mechanism according to claim 8, wherein the reset valve comprises two parallel through holes and two parallel grooves linking the through holes with each other, and wherein the through holes communicate with the duct which bypasses the check valve when the reset valve is in its opened position.

10. The valve actuation mechanism according to claim 8, wherein the reset valve comprises a peripheral surface adapted to obturate the duct which bypasses the check valve when the reset valve is in its closed position.

11. The valve actuation mechanism according to claim 10, wherein the reset valve has a cylindrical form with a circular section.

12. The valve actuation mechanism according to claim 1, wherein it is an exhaust valve actuation mechanism.

13. The valve actuation mechanism according to claim 12, wherein the activation piston activates an exhaust gas recirculation function when it is in its second position.

14. The valve actuation mechanism according to claim 12, wherein the activation piston activates an engine brake function when it is in its second position.

15. The valve actuation mechanism according to claim 14, wherein the engine brake function is realized by opening two exhaust valves and wherein the valve opening force is exerted by the activation piston on the whole valve opening actuator.

16. The valve actuation mechanism according to claim 14, wherein the engine brake function is realized by opening one of two exhaust valves, wherein the portion of the valve opening actuator on which the valve opening force, is exerted is a slider block, on which the valve is mounted and which is movable, with respect to the valve opening, actuator, along the opening axis of the valve, and wherein each rocker comprises a finger adapted to exert, under rotation of the rocker, a valve opening force on the remaining portion, of the valve opening actuator, on which the second valve is mounted.

17. The valve actuation mechanism according to claim 1, wherein it is an intake valve actuation mechanism.

18. An automotive vehicle comprising a valve actuation mechanism according to claim 1.

* * * * *